US012655530B2

(12) United States Patent
Yamagiwa et al.

(10) Patent No.: US 12,655,530 B2
(45) Date of Patent: Jun. 16, 2026

(54) CARBON DIOXIDE ELECTROLYTIC DEVICE AND METHOD OF ELECTROLYZING CARBON DIOXIDE

(71) Applicant: KABUSHIKI KAISHA TOSHIBA, Minato-ku (JP)

(72) Inventors: Masakazu Yamagiwa, Yokohama (JP); Akihiko Ono, Kita (JP); Yuki Kudo, Yokohama (JP); Yusuke Kofuji, Yokohama (JP); Asahi Motoshige, Ota (JP); Yoshitsune Sugano, Kawasaki (JP); Ryota Kitagawa, Setagaya (JP); Satoshi Mikoshiba, Yamato (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 587 days.

(21) Appl. No.: 16/811,681

(22) Filed: Mar. 6, 2020

(65) Prior Publication Data

US 2021/0079541 A1 Mar. 18, 2021

(30) Foreign Application Priority Data

Sep. 17, 2019 (JP) ..... 2019-168884

(51) Int. Cl.
*C25B 15/02* (2021.01)
*C25B 1/00* (2021.01)
(Continued)

(52) U.S. Cl.
CPC ..... *C25B 15/02* (2013.01); *C25B 1/00* (2013.01); *C25B 3/25* (2021.01); *C25B 9/19* (2021.01);
(Continued)

(58) Field of Classification Search
CPC .... C25B 3/25; C25B 3/26; C25B 1/00; C25B 9/19; C25B 15/02; C25B 15/023;
(Continued)

(56) References Cited

U.S. PATENT DOCUMENTS 4,185,142 A * 1/1980 Solomon ..... C25B 1/46 429/49
2005/0260463 A1 11/2005 Chapman et al.
(Continued)

FOREIGN PATENT DOCUMENTS

CN 203112931 U 8/2013
CN 108624905 10/2018
(Continued)

OTHER PUBLICATIONS

Werner S. Zimmt and Nancy Odegaard, Conductivity Measurements: A Discussion and Comparisonof Two Instruments Used to Follow the Removal of SolubleSalts from Ceramics, Sep. 1993, WAAC Newsletter, vol. 15, No. 3, pp. 25-28 (Year: 1993).*
(Continued)

*Primary Examiner* — Luan V Van
*Assistant Examiner* — Mofoluwaso S Jebutu
(74) *Attorney, Agent, or Firm* — Oblon, McClelland, Maier & Neustadt, L.L.P.

(57) ABSTRACT

A carbon dioxide electrolytic device of an embodiment includes: an electrolysis cell including a cathode, an anode, a carbon dioxide supply flow path, solution supply flow paths, and a separator; a rinse solution source which supplies a rinse solution to at least one of the solution supply flow paths and the carbon dioxide supply flow path; a first electric conductivity meter provided on a discharge port side from the electrolysis cell of at least one of the solution supply flow paths and the carbon dioxide supply flow path; and a rinse solution supply controller which controls stop operation of
(Continued)

the rinse solution source according to a measurement result of the first electric conductivity meter.

15 Claims, 9 Drawing Sheets

(51) Int. Cl.

| | |
|---|---|
| ***C25B 3/25*** | (2021.01) |
| ***C25B 9/19*** | (2021.01) |
| ***C25B 15/023*** | (2021.01) |
| ***C25B 15/025*** | (2021.01) |
| ***C25B 15/029*** | (2021.01) |
| ***C25B 15/08*** | (2006.01) |

(52) U.S. Cl.
CPC ..... *C25B 15/023* (2021.01); *C25B 15/025* (2021.01); *C25B 15/029* (2021.01); *C25B 15/08* (2013.01); *C25B 15/083* (2021.01)

(58) Field of Classification Search
CPC ..... C25B 15/025; C25B 15/033; C25B 15/08; C25B 1/02; C25B 1/04
See application file for complete search history.

(56) References Cited

U.S. PATENT DOCUMENTS

| | | | | |
|---|---|---|---|---|
| 2006/0269807 | A1 | 11/2006 | Fujita et al. | |
| 2008/0237054 | A1* | 10/2008 | Sanchez | C25B 15/02 205/335 |
| 2011/0100328 | A1* | 5/2011 | Paul | H01M 8/186 174/138 R |
| 2011/0240484 | A1* | 10/2011 | Pendleton | C25B 1/16 205/510 |
| 2013/0062215 | A1 | 3/2013 | Kurashina et al. | |
| 2013/0105304 | A1 | 5/2013 | Kaczur et al. | |
| 2015/0090602 | A1* | 4/2015 | Sato | C25B 15/02 204/229.1 |
| 2016/0376713 | A1* | 12/2016 | Ono | C25B 1/04 204/230.2 |
| 2017/0175277 | A1* | 6/2017 | Von Olshausen | C25B 1/04 |
| 2018/0066370 | A1 | 3/2018 | Yamada et al. | |
| 2018/0216243 | A1* | 8/2018 | Kudo | C25B 9/73 |
| 2018/0274109 | A1 | 9/2018 | Kudo et al. | |
| 2019/0078222 | A1 | 3/2019 | Baldauf et al. | |
| 2019/0085477 | A1 | 3/2019 | Ono et al. | |
| 2019/0136394 | A1* | 5/2019 | Edgar | C25B 15/031 |
| 2019/0177860 | A1* | 6/2019 | Tembhurne | C25B 3/26 |
| 2019/0226103 | A1* | 7/2019 | Kuhl | C25B 1/02 |
| 2019/0322552 | A1* | 10/2019 | Nakayama | C02F 1/46114 |
| 2020/0220185 | A1* | 7/2020 | Ma | C25B 9/73 |

FOREIGN PATENT DOCUMENTS

| | | | | |
|---|---|---|---|---|
| DE | 102015213947 | A1 * | 1/2017 | |
| DE | 102016211155 | A1 * | 12/2017 | |
| EP | 3 460 104 | A1 | 3/2019 | |
| JP | 2010-150630 | A | 7/2010 | |
| JP | 2013-60625 | A | 4/2013 | |
| JP | 2014-181408 | A | 8/2014 | |
| JP | 2017-155304 | A | 9/2017 | |
| JP | 2018-150596 | A | 8/2018 | |
| JP | 2018-154901 | A | 10/2018 | |
| JP | 108779564 | A | 11/2018 | |
| JP | 2018-66135 | A | 4/2019 | |
| WO | WO-2016193738 | A1 * | 12/2016 | C25B 15/02 |
| WO | WO-2018168876 | A1 * | 9/2018 | |
| WO | WO-2020259888 | A1 * | 12/2020 | |

OTHER PUBLICATIONS

B. Endrödi, E. Kecsenovity, A. Samu, F. Darvas, R. V. Jones, V. Török, A. Danyi, and C. Janáky, Multilayer Electrolyzer Stack Converts Carbon Dioxide to Gas Products at High Pressure with High Efficiency, ACS Energy Letters Jun. 2019 4 (7), 1770-1777 ( Year: 2019).*

* cited by examiner

CARBON DIOXIDE ELECTROLYTIC DEVICE AND METHOD OF ELECTROLYZING CARBON DIOXIDE

CROSS-REFERENCE TO RELATED APPLICATION

This application is based upon and claims the benefit of priority from Japanese Patent Application No. 2019-168884, filed on Sep. 17, 2019; the entire contents of which are incorporated herein by reference.

FIELD

Embodiments described herein relate generally to a carbon dioxide electrolytic device and a method for electrolyzing carbon dioxide.

BACKGROUND

In recent years, from both viewpoints of energy problems and environmental problems, it is desired not only to use renewable energy but also to convert it to a storable and transportable state. However, the power generation of renewable energy sources such as solar cells and wind power generation depends on weather and other natural conditions, and thereby, it is difficult to realize a stable electric power supply. With respect to the above point, attempts have been made to store the generated electric power, but the cost of a storage battery and the loss during storage are problems.

Thus, attention is focused on a technology in which water electrolysis is performed electrochemically, or carbon dioxide is reduced electrochemically to be converted into a chemical substance, by using the renewable energy. Such a technology also allows the energy to be stored as storable fuel. Moreover, the renewable energy is converted into chemical energy to produce chemical substances for industrial raw materials, making this technology promising for creating value. Concretely, performing the water electrolysis electrochemically makes it possible to manufacture hydrogen ($H_2$) from water ($H_2O$). Further, it is possible that carbon dioxide ($CO_2$) is reduced electrochemically to be converted into a chemical substance such as carbon monoxide (CO), formic acid (HCOOH), methanol ($CH_3OH$), methane ($CH_4$), acetic acid ($CH_3COOH$), ethanol ($C_2H_5OH$), ethane ($C_2H_6$), or ethylene ($C_2H_4$). These chemical substances are high in energy density and can be stored in a cylinder or a tank, which allows a reduction in a storage cost of energy, and allows suppression of a storage loss.

As a carbon dioxide electrolytic device, for example, a structure in which a cathode solution and $CO_2$ gas are brought into contact with the cathode, and an anode solution is brought into contact with an anode is being studied. As a concrete configuration of the electrolytic device, for example, there can be cited a configuration which includes a cathode solution flow path disposed along one surface of the cathode, a $CO_2$ gas flow path disposed along the other surface of the cathode, an anode solution flow path disposed along one surface of an anode, and a separator disposed between the cathode solution flow path and the anode solution flow path. Such a configuration is referred to as an electrolysis cell here. When a reaction of producing, for example, CO from $CO_2$ is performed for a long period of time by making a constant current flow through the cathode and the anode using such an electrolysis cell, problems such as the deterioration over time of cell output, the reduction of production amount of CO, or the increase in cell voltage occurs. From this situation, there have been demanded a carbon dioxide electrolytic device which makes it possible to suppress the deterioration over time of the cell output and operate the electrolysis cell efficiently and a control mechanism thereof.

DETAILED DESCRIPTION

A carbon dioxide electrolytic device of an embodiment includes: an electrolysis cell including a cathode to reduce carbon dioxide and thus produce a carbon compound, an anode to oxidize water and thus produce oxygen, a carbon dioxide supply flow pass to supply carbon dioxide so as to be brought into contact with the cathode, a solution supply flow path to supply an electrolytic solution so as to be brought into contact with at least the anode among the cathode and the anode, and a separator separating the anode and the cathode; a rinse solution source configured to supply a rinse solution to at least one of the solution supply flow path and the carbon dioxide supply flow path of the electrolysis cell; a first electric conductivity meter provided on a discharge port side from the electrolysis cell of at least one of the solution supply flow path and the carbon dioxide supply flow path; and a rinse solution supply controller configured to control stop operation of the rinse solution source according to a measurement result of the first electric conductivity meter.

Hereinafter, a carbon dioxide electrolytic device and a method of electrolyzing carbon dioxide of embodiments will be described with reference to the drawings. In each embodiment presented below, substantially the same components are denoted by the same reference signs, and a description thereof is sometimes partially omitted. The drawings are schematic, and a relationship between a thickness and a size, thickness proportions of the respective portions, and the like are sometimes different from actual ones.

First Embodiment

Figure 1:
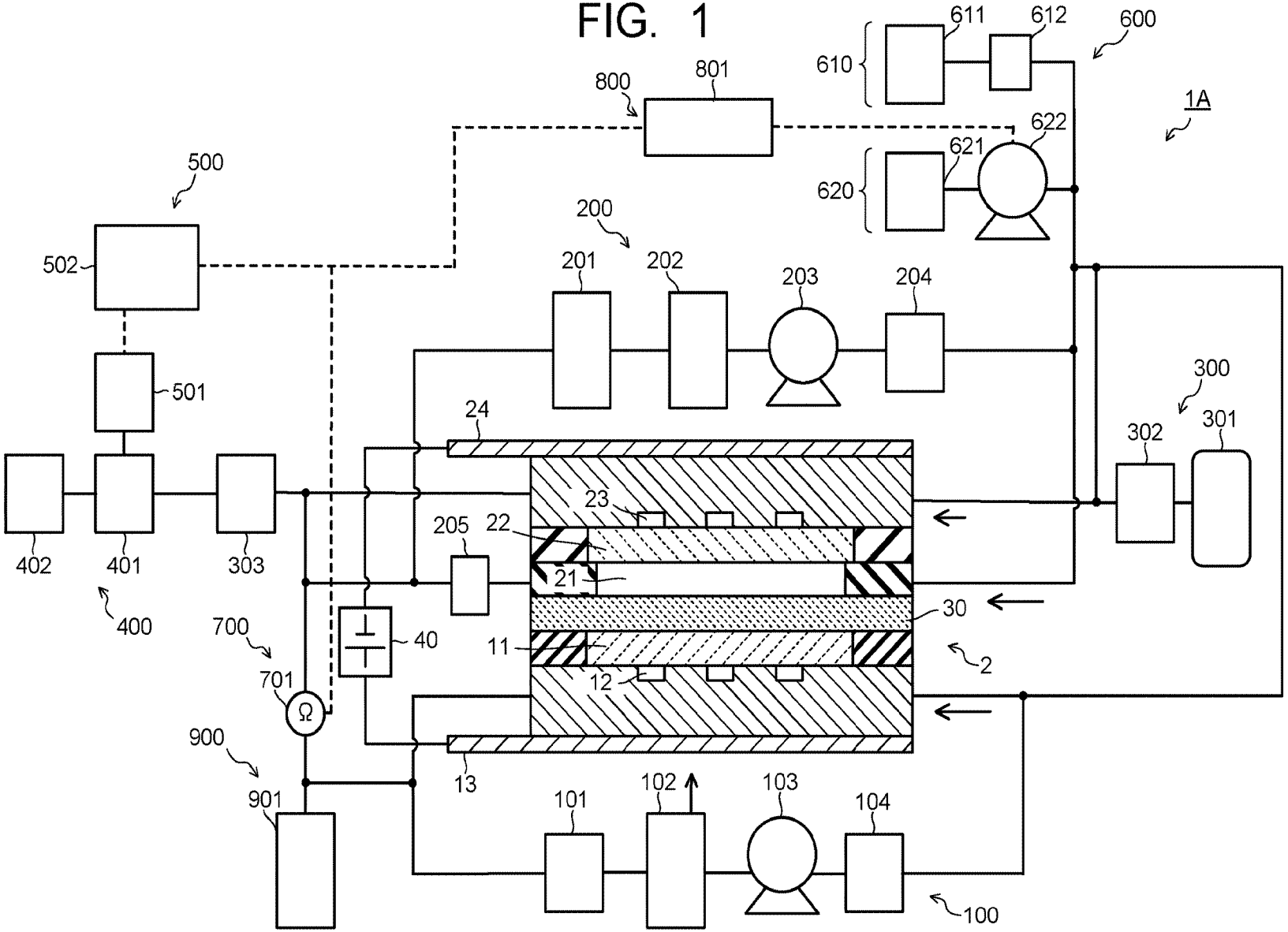
FIG. 1 is a view illustrating a carbon dioxide electrolytic device of a first embodiment.
Figure 2:
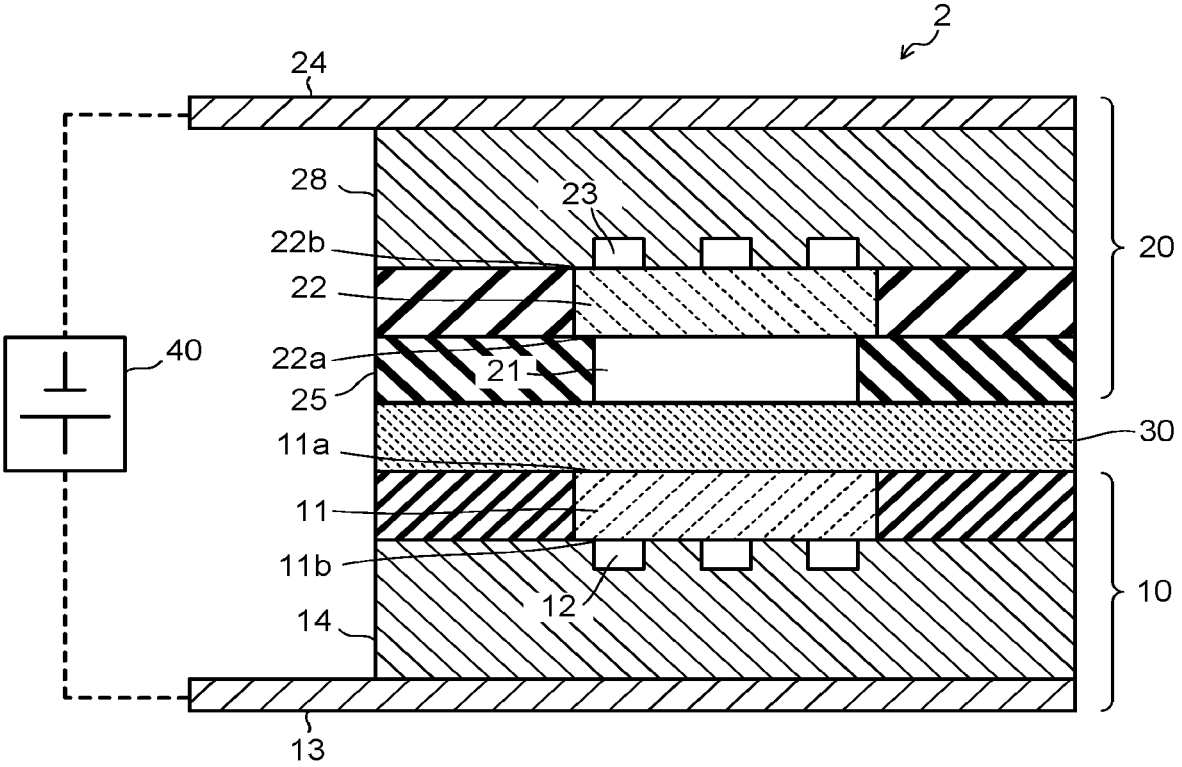
FIG. 2 is a sectional view illustrating one example of an electrolysis cell of the carbon dioxide electrolytic device illustrated in FIG. 1.
Figure 3:
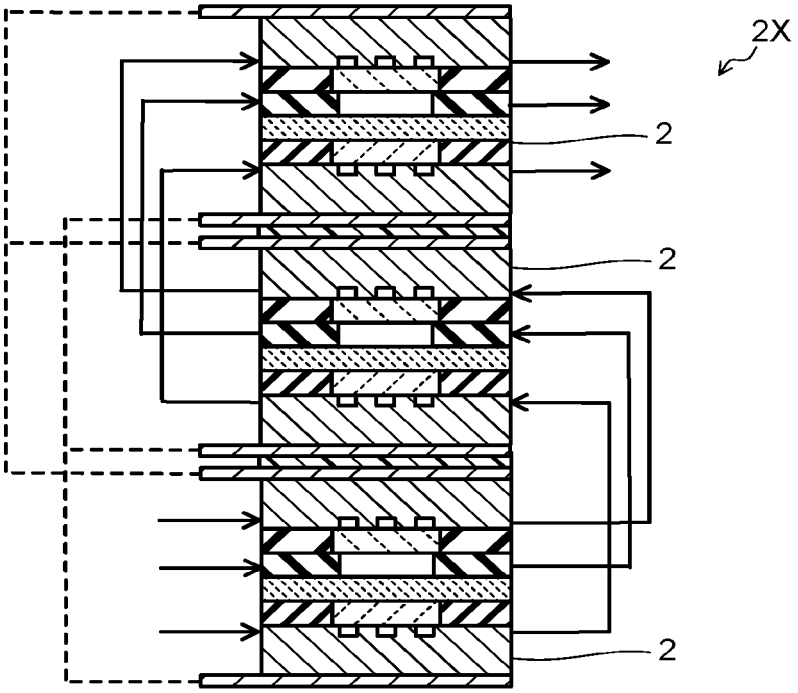
FIG. 3 is a sectional view illustrating another example of an electrolysis cell of the carbon dioxide electrolytic device illustrated in FIG. 1.

FIG. 1 is a view illustrating a configuration of a carbon dioxide electrolytic device 1 (1A) according to a first embodiment, and FIG. 2 and FIG. 3 are each a sectional view illustrating a configuration of an electrolysis cell in the electrolytic device illustrated in FIG. 1. The carbon dioxide electrolytic device 1A illustrated in FIG. 1 includes an electrolysis cell 2, an anode solution supply system 100 which supplies an anode solution to the electrolysis cell 2, a cathode solution supply system 200 which supplies a cathode solution to the electrolysis cell 2, a gas supply system 300 which supplies carbon dioxide gas to the electrolysis cell 2, a product collection system 400 which collects a product produced by a reduction reaction in the electrolysis cell 2, an electrolysis operation control system 500 which detects reduction performance from the collected product, and controls electrolysis operation of the electrolysis cell 2, a refresh material supply system 600 which supplies a refresh material such as a rinse solution or a gaseous substance to the electrolysis cell 2, a conductivity measurement system 700 which measures an electric conductivity of the rinse solution discharged from the electrolysis cell 2, a refresh operation control system 800 which controls refresh operation, and a waste solution collection system 900 which collects a waste solution of the cathode solution and the anode solution, and the rinse solution.

As illustrated in FIG. 2, the electrolysis cell 2 includes an anode part 10, a cathode part 20, and a separator 30. The anode part 10 includes an anode 11, an anode solution flow path 12, and an anode current collector 13. The cathode part 20 includes a cathode solution flow path 21, a cathode 22, a $CO_2$ gas flow path 23, and a cathode current collector 24. The separator 30 is disposed to separate the anode part 10 and the cathode part 20. The electrolysis cell 2 is sandwiched by a pair of support plates, which are not illustrated, and further tightened by bolts or the like. The electrolysis cell 2 is not limited to a single cell as illustrated in FIG. 2, and may be a stack-type electrolysis cell 2X in which a plurality of the electrolysis cells 2 are stacked as illustrated in FIG. 3.

In FIG. 1 to FIG. 3, a reference sign 40 indicates a power supply which makes a current flow through the anode 11 and the cathode 22. The power supply 40 is connected via the anode current collector 13 and the cathode current collector 24 to the anode 11 and the cathode 22. The power supply 40 is not limited to a normal system power supply, battery, or the like, and may be a power source which supplies electric power generated by renewable energy such as a solar cell or wind power generation. In the respective electrolysis cells 2 of the stack-type electrolysis cell 2X illustrated in FIG. 3, the anode current collectors 13 and the cathode current collectors 24 connected to the power supply 40 are connected in parallel, and the solution flow paths 12 and 21 and the $CO_2$ gas flow paths 23 are connected in series.

The anode 11 is an electrode (oxidation electrode) which causes an oxidation reaction of water ($H_2O$) in an anode solution as an electrolytic solution to produce oxygen ($O_2$) or hydrogen ions ($H^+$). The anode 11 has a first surface 11*a* which is brought into contact with the separator 30, and a second surface 11*b* which faces the anode solution flow path 12. The first surface 11*a* of the anode 11 is brought into close contact with the separator 30. The anode solution flow path 12 supplies the anode solution to the anode 11, and is formed of a pit (groove portion/concave portion) provided in a first flow path plate 14. The anode solution flows through in the anode solution flow path 12 so as to be brought into contact with the anode 11.

It is preferable that the anode 11 is mainly composed of a catalyst material (anode catalyst material) capable of oxidizing $H_2O$ to produce oxygen or hydrogen ions and capable of reducing an overvoltage in the above reaction. As such a catalyst material, there can be cited a metal such as platinum (Pt), palladium (Pd), or nickel (Ni), an alloy or an intermetallic compound containing the above metals, a binary metal oxide such as a manganese oxide (Mn—O), an iridium oxide (Ir—O), a nickel oxide (Ni—O), a cobalt oxide (Co—O), an iron oxide (Fe—O), a tin oxide (Sn—O), an indium oxide (In—O), a ruthenium oxide (Ru—O), a lithium oxide (Li—O), or a lanthanum oxide (La—O), a ternary metal oxide such as Ni—Co—O, Ni—Fe—O, La—Co—O, Ni—La—O, or Sr—Fe—O, a quaternary metal oxide such as Pb—Ru—Ir—O or La—Sr—Co—O, or a metal complex such as a Ru complex or an Fe complex.

The cathode 22 is an electrode (reduction electrode) which causes a reduction reaction of carbon dioxide ($CO_2$) to produce a carbon compound such as carbon monoxide (CO), methane ($CH_4$), ethane ($C_2H_6$), ethylene ($C_2H_4$), methanol ($CH_3OH$), ethanol ($C_2H_5OH$), or ethylene glycol ($C_2H_6O_2$). In the cathode 22, there is a case where a side reaction in which hydrogen ($H_2$) is produced by a reduction reaction of water ($H_2O$) is caused simultaneously with the reduction reaction of carbon dioxide ($CO_2$). The cathode 22 has a first surface 22*a* facing the cathode solution flow path 21, and a second surface 22*b* facing the $CO_2$ gas flow path 23. The cathode solution flow path 21 is disposed between the cathode 22 and the separator 30 so that the cathode solution as an electrolytic solution is brought into contact with the cathode 22 and the separator 30.

The cathode solution flow path 21 is formed of an opening portion provided in a second flow path plate 25. For the second flow path plate 25, there are provided a solution inlet port and a solution outlet port whose illustrations are omitted, and the cathode solution is introduced and discharged by the cathode solution supply system 200 via these solution inlet port and solution outlet port. The cathode solution flows through in the cathode solution flow path 21 so as to be brought into contact with the cathode 22 and the separator 30. It is preferable to use a material having low chemical reactivity and having no conductivity for the second flow path plate 25 forming the cathode solution flow path 21. As such a material, there can be cited an insulating resin material such as an acrylic resin, polyetheretherketone (PEEK), or a fluorocarbon resin.

In the cathode 22, the reduction reaction of $CO_2$ occurs mainly in a portion which is brought into contact with the cathode solution. For this reason, the cathode solution flow path 21 preferably has an opening portion with a wide opening area. The $CO_2$ gas flow path 23 is formed of a pit (groove portion/concave portion) provided in a third flow path plate 28. Into/from the $CO_2$ gas flow path 23, $CO_2$ gas or gas containing $CO_2$ (collectively, sometimes referred to simply as $CO_2$ gas) is introduced and discharged by the gas supply system 300. It is preferable to use a material having low chemical reactivity and high conductivity for the third flow path plate 28 forming the $CO_2$ gas flow path. As such a material, there can be cited a metal material such as Ti or SUS, carbon, or the like. Note that for each of the first flow path plate 14, the second flow path plate 25, and the third flow path plate 28, an inlet port and an outlet port for a solution or gas, screw holes for tightening, and the like, whose illustrations are omitted, are provided. Further, in front of and behind each of the flow path plates 14, 25, and 28, packing whose illustration is omitted is sandwiched according to need.

The cathode 22 has, for example, a gas diffusion layer and a cathode catalyst layer provided thereon. It is also possible that a porous layer which is denser and smaller in average pore size than the gas diffusion layer is disposed between the gas diffusion layer and the cathode catalyst layer. The gas diffusion layer is disposed on the $CO_2$ gas flow path 23 side, and the cathode catalyst layer is disposed on the cathode solution flow path side. The cathode catalyst layer may enter the gas diffusion layer. The cathode catalyst layer preferably has catalyst nanoparticles, a catalyst nanostructure, or the like. The gas diffusion layer is formed of, for example, carbon paper, carbon cloth, or the like, and water repellent treatment is performed thereon. The porous layer is formed of a porous body whose pore size is smaller than that of the carbon paper or the carbon cloth. The reduction reaction of $CO_2$ occurs in the vicinity of a boundary between the gas diffusion layer and the cathode catalyst layer, a gaseous product is discharged mainly from the $CO_2$ gas flow path, and a liquid product is discharged mainly from the cathode solution flow path 21.

The cathode catalyst layer is preferably composed of a catalyst material (cathode catalyst material) capable of reducing carbon dioxide to produce a carbon compound and capable of reducing an overvoltage in the above reaction. As such a material, there can be cited a metal such as gold (Au), silver (Ag), copper (Cu), platinum (Pt), palladium (Pd), nickel (Ni), cobalt (Co), iron (Fe), manganese (Mn), titanium (Ti), cadmium (Cd), zinc (Zn), indium (In), gallium (Ga), lead (Pb), or tin (Sn), a metal material such as an alloy or an intermetallic compound containing at least one of the above metals, a carbon material such as carbon (C), graphene, CNT (carbon nanotube), fullerene, or ketjen black, or a metal complex such as a Ru complex or a Re complex. The cathode catalyst layer can employ various shapes such as a plate shape, a mesh shape, a wire shape, a particle shape, a porous shape, a thin film shape, and an island shape.

The separator 30 is formed of an ion exchange membrane or the like capable of moving ions between the anode 11 and the cathode 22, and capable of separating the anode part 10 and the cathode part 20. As the ion exchange membrane, it is possible to use, for example, a cation exchange membrane such as Nafion or Flemion, or an anion exchange membrane such as Neosepta or Selemion. Note that other than the ion exchange membrane, it is also possible to apply a glass filter, a porous polymeric membrane, a porous insulating material, or the like to the separator 30, as long as they are a material capable of moving ions between the anode 11 and the cathode 22.

Each of the anode solution and the cathode solution as the electrolytic solution is preferably a solution containing at least water ($H_2O$). Because carbon dioxide ($CO_2$) is supplied from the $CO_2$ gas flow path 23, the cathode solution may contain or need not contain carbon dioxide ($CO_2$). To the anode solution and the cathode solution, the same solution may be applied or different solutions may be applied. As a solution containing $H_2O$ used as the anode solution and the cathode solution, an aqueous solution containing an arbitrary electrolyte can be cited. As the aqueous solution containing the electrolyte, there can be cited, for example, an aqueous solution containing at least one selected from a hydroxide ion (OH), a hydrogen ion ($H^+$), a potassium ion ($K^+$), a sodium ion ($Na^+$), a lithium ion ($Li^+$), a chloride ion (Cl), a bromide ion (Br), an iodide ion (I), a nitrate ion ($NO_3$), a sulfate ion ($SO_4^{2-}$), a phosphate ion ($PO_4^{2-}$), a borate ion ($BO_3^{3-}$), a carbonate ion ($CO_3^{2-}$), and a hydrogen carbonate ion ($HCO_3$).

For the cathode solution, it is also possible to use an ionic liquid which is made of salts of cations such as imidazolium ions or pyridinium ions and anions such as $BF_4^-$ or $PF_6^-$ and which is in a liquid state in a wide temperature range, or its aqueous solution. As another cathode solution, there can be cited an amine solution of ethanolamine, imidazole, pyridine, or the like, or an aqueous solution thereof. As amine, any of primary amine, secondary amine, and tertiary amine is applicable.

To the anode solution flow path 12 of the anode part 10, the anode solution is supplied from the anode solution supply system 100. The anode solution supply system 100 circulates the anode solution so that the anode solution flows through in the anode solution flow path 12. The anode solution supply system 100 has a pressure controller 101, an anode solution tank 102, a flow rate regulator (pump) 103, and a reference electrode 104, and is configured to circulate the anode solution in the anode solution flow path 12. The anode solution tank 102 is connected to a not-illustrated gas component collection unit which collects a gas component such as oxygen (02) contained in the circulating anode solution. The anode solution is introduced into the anode solution flow path 12 after a flow rate and a pressure thereof are controlled in the pressure controller 101 and the flow rate regulator 103.

To the cathode solution flow path 21 of the cathode part 20, the cathode solution is supplied from the cathode solution supply system 200. The cathode solution supply system 200 circulates the cathode solution so that the cathode solution flows through in the cathode solution flow path 21. The cathode solution supply system 200 has a pressure controller 201, a cathode solution tank 202, a flow rate regulator (pump) 203, a reference electrode 204, and a pressure controller 205, and is configured to circulate the cathode solution in the cathode solution flow path 21. The cathode solution is introduced into the cathode solution flow path 21 after a flow rate and a pressure thereof are controlled in the pressure controller 201 and the flow rate regulator 203.

To the $CO_2$ gas flow path 23, the $CO_2$ gas is supplied from the gas supply system 300. The gas supply system 300 has a $CO_2$ gas cylinder 301, a flow rate regulator 302, and a pressure controller 303. The $CO_2$ gas is introduced into the $CO_2$ gas flow path 23 after a flow rate and a pressure thereof are controlled in the flow rate regulator 302 and the pressure controller 303. The gas supply system 300 is connected to the product collection system 400 which collects a product in the gas flowed through the $CO_2$ gas flow path 23. The product collection system 400 has a gas/liquid separation unit 401 and a product collection unit 402. A reduction product such as CO or $H_2$ contained in the gas flowed through the $CO_2$ gas flow path 23 is accumulated in the product collection unit 402 via the gas/liquid separation unit 401.

The anode solution and the cathode solution circulate in the anode solution flow path 12 and the cathode solution flow path 21 during an electrolytic reaction operation, as described above. During a refresh operation of the electrolysis cell 2 to be described later, the anode solution and the cathode solution are discharged to the waste solution collection system 900 so that the anode 11, the anode solution flow path 12, the cathode 22, the cathode solution flow path 21, and so on are exposed from the anode solution and the cathode solution. The waste solution collection system 900 has a waste solution collection tank 901 connected to the anode solution flow path 12 and the cathode solution flow path 21. Waste solutions of the anode solution and the cathode solution are collected in the waste solution collection tank 901 by opening and closing not-illustrated valves. The opening and closing of the valves, or the like is controlled by the electrolysis operation control system 500.

The refresh material supply system 600 includes a gas source 610 which supplies a gaseous refresh substance (refresh gas) and a rinse solution source 620 which supplies a liquid refresh substance (rinse solution). The gas source 610 has a gas tank 611 to be a supply source of a refresh gas such as air, carbon dioxide, oxygen, nitrogen, or argon, and a pressure controller 612 which controls a supply pressure of the gaseous substance. The rinse solution source 620 has a rinse solution tank 621 to be a supply source of a rinse solution such as water and a flow rate regulator (pump) 622 which controls a supply flow rate or the like of the rinse solution. The gas source 610 and the rinse solution source 620 are connected via pipes to the anode solution flow path 12, the cathode solution flow path 21, and the $CO_2$ gas flow path 23. The gaseous substance and the rinse solution are supplied to each of the flow paths 12, 21, and 23 by opening and closing not-illustrated valves. The opening and closing of the valves, or the like is controlled by the electrolysis operation control system 500 or the refresh operation control system 800.

The waste solution collection tank 901 also functions as a collection unit of the rinse solution supplied from the rinse solution source 620. On a pipe from the anode solution flow path 12, the cathode solution flow path 21, and the $CO_2$ gas flow path 23 to the waste solution collection tank 901, namely, on a discharge port side from the electrolysis cell 2 of the anode solution flow path 12, the cathode solution flow path 21, and the $CO_2$ gas flow path 23, an electric conductivity meter 701 which measures an electric conductivity of the rinse solution passed through in the electrolysis cell 2 is provided. The conductivity measurement system 700 has the electric conductivity meter (first electric conductivity meter) 701. The electric conductivity meter 701 is electrically connected to a data collection and controller 502 of the electrolysis operation control system 500 and a refresh operation controller 801 of the refresh operation control system 800, and controlled by the refresh operation controller 801 so as to measure the electric conductivity of the rinse solution at any time during the refresh operation. The operation of the flow rate regulator (pump) 622 for the rinse solution is controlled by the refresh operation controller 801 based on a measurement result of the electric conductivity meter 701 as described in detail later.

A part of the reduction product separated by the gas/liquid separation unit 401 of the product collection system 400 is sent to a reduction performance detection unit 501 of the electrolysis operation control system 500. In the reduction performance detection unit 501, a production amount and a proportion of each product such as CO or $H_2$ in the reduction product, are detected. The detected production amount and proportion of each product are input to a data collection and controller 502 of the electrolysis operation control system 500. Further, the data collection and controller 502 collects electrical data such as a cell voltage, a cell current, a cathode potential, and an anode potential as part of a cell output indicating electrolytic performance of the electrolysis cell 2, and the data is input to the data collection and controller 502. When the stack-type electrolysis cell 2X illustrated in FIG. 3 is used, data of each of the cells 2 need not be collected, and it is only necessary to collect a cell voltage, a cell current, a cathode potential, an anode potential, and so on as the stack-type electrolysis cell 2X. A case of detecting a production amount and a proportion of each product such as CO or $H_2$ in the reduction product is also similar.

The data collection and controller 502 is electrically connected, via bi-directional signal lines whose illustration is partially omitted, to the pressure controller 101 and the flow rate regulator 103 of the anode solution supply system 100, the pressure controller 201 and the flow rate regulator 203 of the cathode solution supply system 200, and the flow rate regulator 302 and the pressure controller 304 of the gas supply system 300, in addition to the reduction performance detection unit 501, and these are collectively controlled. The data collection and controller 502 is electrically connected further to the refresh operation controller 801. The data collection and controller 502 and the refresh operation controller 801 may configure the controllers individually, or may be an integrated controller. The controllers 502 and 801 are each configured by, for example, a computer such as a PC or a microcomputer, and configured to perform arithmetic processing of a data signal output from each unit and to send a signal of controlling the operation of each unit to a necessary part so that each unit is properly operated.

Figure 4:
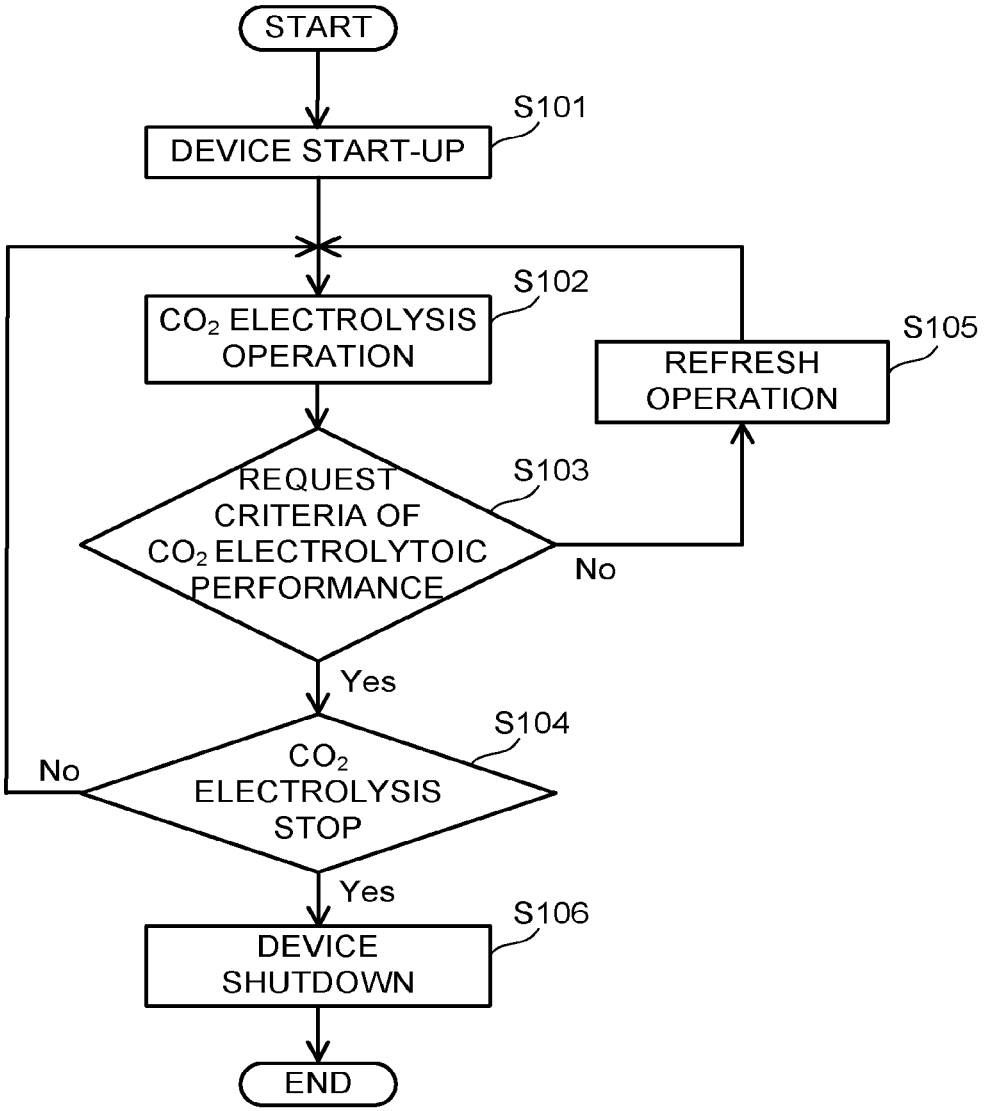
FIG. 4 is a chart illustrating an operation step of the carbon dioxide electrolytic device of the first embodiment.

A working operation of the carbon dioxide electrolytic device 1A of the embodiment will be described. First, as illustrated in FIG. 4, a start-up step S101 of the electrolytic device 1A is performed. In the start-up step S101 of the electrolytic device 1A, the following operation is performed. In the anode solution supply system 100, a flow rate and a pressure are controlled by the pressure controller 101 and the flow rate regulator 103, and the anode solution is introduced into the anode solution flow path 12. In the cathode solution supply system 200, a flow rate and a pressure are controlled by the pressure controller 201 and the flow rate regulator 203, and the cathode solution is introduced into the cathode solution flow path 21. In the gas supply system 300, a flow rate and a pressure are controlled by the flow rate regulator 302 and the pressure controller 304, and $CO_2$ gas is introduced into the $CO_2$ gas flow path 23.

Next, a $CO_2$ electrolysis operation step S102 is performed. In the $CO_2$ electrolysis operation step S102, an output from the power supply 40 is started with respect to the electrolytic device 1A after being subjected to the start-up step S101, and a current is supplied by applying the voltage between the anode 11 and the cathode 22. When the current is made to flow between the anode 11 and the cathode 22, an oxidation reaction in the vicinity of the anode 11 and a reduction reaction in the vicinity of the cathode 22 occur, which will be described below. Here, a case of producing carbon monoxide (CO) as the carbon compound being a reduction reaction product of $CO_2$ is mainly described, but, the carbon compound as the reduction product of carbon dioxide is not limited to carbon monoxide, and may be other carbon compounds such as the above-described organic compounds.

When a current is supplied from the power supply 40 between the anode 11 and the cathode 22, an oxidation reaction of water ($H_2O$) occurs in the anode 11 which is brought into contact with the anode solution. Concretely, as presented in the following formula (1), $H_2O$ contained in the anode solution is oxidized, and oxygen ($O_2$) and hydrogen ions ($H^+$) are produced.

$$2H_2O \longrightarrow 4H^+ + O_2 + 4e^- \quad (1)$$

$H^+$ produced in the anode 11 moves in the anode solution existing in the anode 11, the separator 30, and the cathode solution in the cathode solution flow path 21, and reaches the vicinity of the cathode 22. The reduction reaction of carbon dioxide ($CO_2$) occurs by electrons (e) based on the current supplied from the power supply 40 to the cathode 22 and $H^+$ moved to the vicinity of the cathode 22. Concretely, as presented in the following formula (2), $CO_2$ supplied from the $CO_2$ gas flow path 23 to the cathode 22 is reduced, and CO is produced.

$$2CO_2 + 4H^+ + 4e^- \longrightarrow 2CO + 2H_2O \tag{2}$$

In the above-described reaction processes in the cathode 22, when a salt, for example, a salt caused by an electrolyte in the solution of a carbonate, a hydrogencarbonate, or the like, precipitates gradually inside any of the anode solution flow path 12, the cathode solution flow path 21, and the $CO_2$ gas flow path 23, to inhibit a flow of the anode solution, the cathode solution, the $CO_2$ gas, or the like, there occurs a trouble such that the production amount of CO obtained by the reduction reaction of $CO_2$ reduces or the cell voltage increases. The reduction in the electrolytic performance due to the electrolysis cell 2 as above is also caused by deviation of distribution of ions and residual gas in the vicinity of the anode 11 and the cathode 22, the precipitation of the electrolyte in the cathode 22, the anode 11, or the $CO_2$ gas flow path 23, or the like. In order to detect such a reduction in the electrolytic performance, the electrolytic performance is monitored constantly by the data collection and controller 502 based on an output of the reduction performance detection unit 501. Then, a step S103 in which it is determined whether or not the output of the reduction performance detection unit 501 satisfies request criteria is performed.

The data collection and controller 502 collects the production amount and the proportion of each product and electrolytic performance data indicating the electrolytic performance such as the cell voltage, the cell current, the cathode potential, and the anode potential regularly or continuously, for example, as described above. Further, in the data collection and controller 502, the request criteria of the electrolytic performance data are previously set, and it is determined whether or not collected electrolytic performance data satisfies the set request criteria. When the collected electrolytic performance data satisfies the set request criteria, the $CO_2$ electrolysis operation S102 is continued without performing a $CO_2$ electrolysis stop (S104). When the collected electrolytic performance data does not satisfy the set request criteria, it is determined that flow path closing due to the precipitation of the salt, or the like occurs, and a refresh operation step S105 is performed. The refresh operation step S105 is performed when at least one piece of the electrolytic performance data does not satisfy the request criterion.

The refresh operation step S105 is performed according to a flowchart illustrated in FIG. 4, for example. First, the output of the power supply 40 is stopped (S201), to thereby stop the reduction reaction of $CO_2$. Next, the cathode solution and the anode solution are discharged from the cathode solution flow path 21 and the anode solution flow path 12 (S202). Next, the rinse solution is supplied to the cathode solution flow path 21, the anode solution flow path 12, and the $CO_2$ gas flow path 23 (S203), to thereby perform washing. After starting the supply of the rinse solution, by the electric conductivity meter 701 placed on the discharge port side from the electrolysis cell 2 of the anode solution flow path 12, the cathode solution flow path 21, and the $CO_2$ gas flow path 23, measurement of an electric conductivity of the rinse solution passed through the electrolysis cell 2 is started (S204). The measurement of the electric conductivity is constantly performed.

It is determined whether or not the measured electric conductivity satisfies a request criterion (S205). The electric conductivity of the rinse solution passed through the electrolysis cell 2 indicates a salt concentration in the rinse solution. Accordingly, a high electric conductivity of the rinse solution means that the salt precipitated in the cathode solution flow path 21, the anode solution flow path 12, or the $CO_2$ gas flow path 23 dissolves in the rinse solution and rinse treatment does not progress sufficiently yet. When the electric conductivity of the rinse solution is reduced sufficiently and a time change in the electric conductivity is below a request criterion, the refresh operation controller 801 determines that the concentration of the salt dissolved in the rinse solution is sufficiently small, and stops the supply of the rinse solution (S206).

Next, gas (refresh gas) is supplied to the cathode solution flow path 21, the anode solution flow path 12, and the $CO_2$ gas flow path 23 (S207), to thereby dry the cathode 22 and the anode 11. When the above refresh operation is finished, the cathode solution is introduced into the cathode solution flow path 21, the anode solution is introduced into the anode solution flow path 12, and the $CO_2$ gas is introduced into the $CO_2$ gas flow path 23 (S208). Subsequently, the output of the power supply 40 is started (S209), to resume the $CO_2$ electrolysis operation. For the discharge of the cathode solution and the anode solution from the respective flow paths 12 and 21, gas may be used or the rinse solution may be used.

The above is the description regarding the case where the rinse solution and gas for refresh are supplied to both the anode part 10 and the cathode part 20, but, the rinse solution and refresh gas for refresh may be supplied to only one of the anode part 10 and the cathode part 20. For example, depending on a type of the electrolytic solutions (anode solution and cathode solution) to be used, there is sometimes a tendency that precipitation easily occurs in one of the anode part 10 and the cathode part 20. Based on such a tendency of the electrolytic device 1A, the rinse solution and refresh gas for refresh may be supplied to only one of the anode part 10 and the cathode part 20. The refresh operation step S105 can be changed in various ways according to an operation condition, a tendency, and the like of the electrolytic device 1A.

As described above, in the electrolytic device 1A of the first embodiment, based on whether or not the electrolytic performance of the electrolysis cell 2 satisfies the request criteria, it is determined whether or not the refresh operation step S105 is performed. Accordingly, the refresh operation step can be performed without excessively reducing a time to perform the $CO_2$ electrolysis operation step. Moreover, the supply of the rinse solution in the refresh operation step is stopped based on the measurement result of the electric conductivity of the rinse solution passed through the electrolysis cell 2. Consequently, the refresh operation step is prevented from being excessively performed, which allows a refresh operation time and an interruption time of an electrolysis operation time to be reduced. Repeating the above $CO_2$ electrolysis operation step and refresh operation step makes it possible to operate the electrolysis cell 2 efficiently while maintaining the electrolytic performance of the electrolysis cell 2 for a long period of time. Further, when the stack-type electrolysis cell 2X is used, without detecting a reduction in the electrolytic performance due to the salt precipitation of the individual cells 2, the rinse solution can be supplied for a sufficient time to be required.

Second Embodiment

Figure 6:
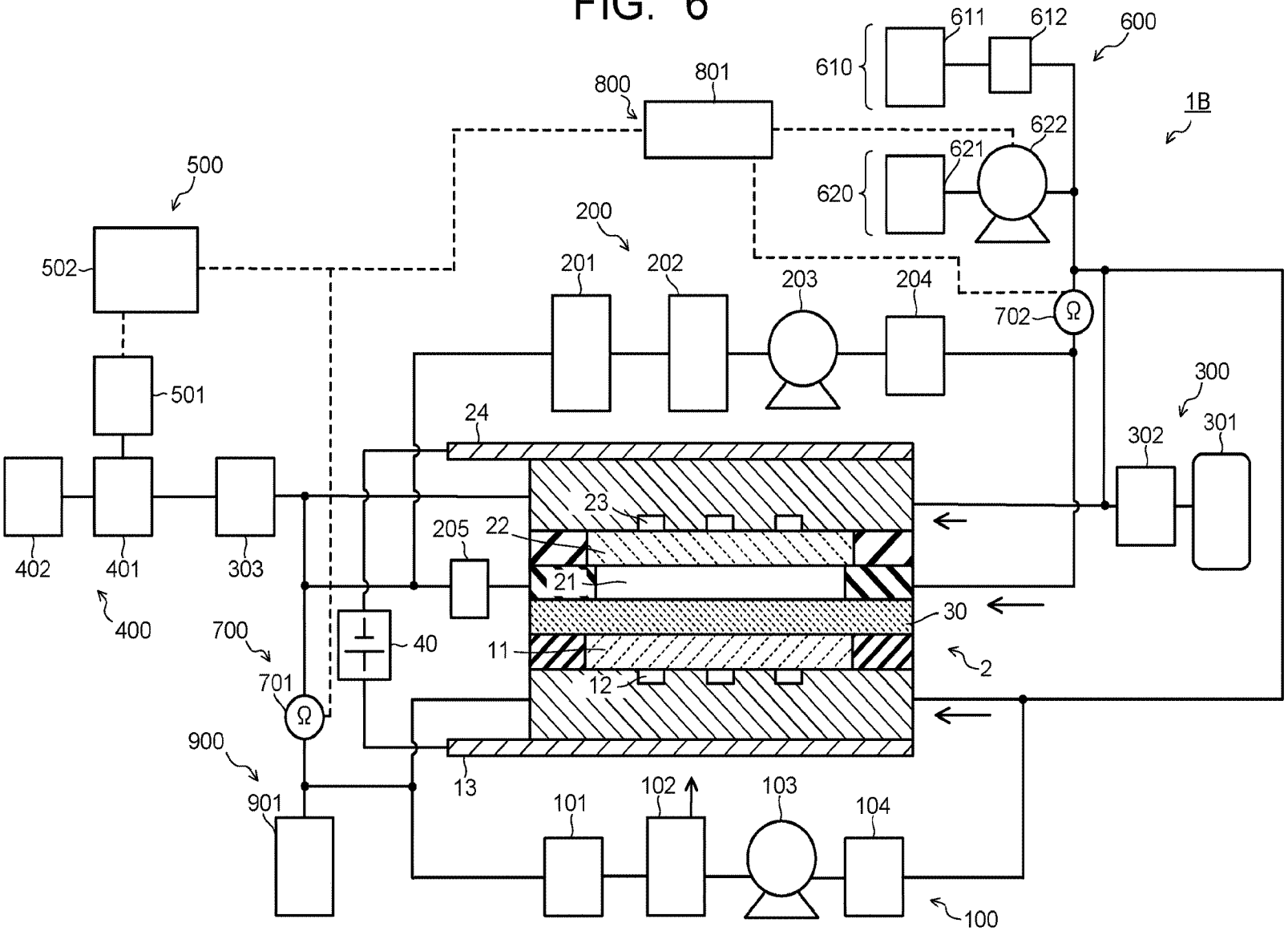
FIG. 6 is a view illustrating a carbon dioxide electrolytic device of a second embodiment.

FIG. 6 is a view illustrating a configuration of a carbon dioxide electrolytic device 1B according to a second embodiment. The carbon dioxide electrolytic device 1B illustrated in FIG. 6 is the one in which a second electric conductivity meter 702 which measures an electric conductivity of a rinse solution before being introduced into an electrolysis cell 2 is added, on an inflow port side to the electrolysis cell 2 of a valve for supplying the rinse solution from a flow rate regulator (pump) 622 of a rinse solution source 620 to the electrolysis cell 2, a rinse solution supply valve, to the configuration of the carbon dioxide electrolytic device 1A according to the first embodiment, and has a basically similar configuration to that of the carbon dioxide electrolytic device 1A according to the first embodiment except it. The second electric conductivity meter 702 is electrically connected to a data collection and controller 502 and a refresh operation controller 801 similarly to a first electric conductivity meter 701, and controlled by the refresh operation controller 801 so as to measure the electric conductivity of the rinse solution before being introduced into the electrolysis cell 2 at any time during the refresh operation. The single electrolysis cell 2 is used in FIG. 6, but the stack-type electrolysis cell 2X illustrated in FIG. 3 may be used similarly to the first embodiment.

In the carbon dioxide electrolytic device 1B according to the second embodiment, a conductivity measurement system 700 has the first electric conductivity meter 701 provided on a discharge port side from the electrolysis cell 2 and the second electric conductivity meter 702 provided on the inflow port side to the electrolysis cell 2. This makes it possible to obtain a difference in electric conductivity of the rinse solution between before the inflow and after the outflow to/from the electrolysis cell 2. By determining whether or not the rinse treatment (washing) of the electrolysis cell 2 is sufficient based on the difference between the electric conductivities of the rinse solution, regardless of a type of the rinse solution, a concentration of a salt contained in the rinse solution after washing can be estimated. For example, when the precipitated salt is dissolved, it is sometimes effective to use a slightly acidic rinse solution. Also in the above case, using the difference between the electric conductivities of the rinse solution makes it possible to accurately determine whether or not the washing treatment is sufficient.

A working operation of the carbon dioxide electrolytic device 1B of the second embodiment will be described. Similarly to the working operation of the first electrolytic device 1A illustrated in FIG. 4, a start-up step S101, a $CO_2$ electrolysis operation step S102, and a determining step S103 of whether or not electrolytic performance satisfies request criteria, of the electrolytic device 1B, are performed. When electrolytic performance data satisfies the request criteria, the $CO_2$ electrolysis operation step S102 is continued, and when the electrolytic performance data does not satisfy the request criteria, a refresh operation step S105 is performed.

Figure 7:
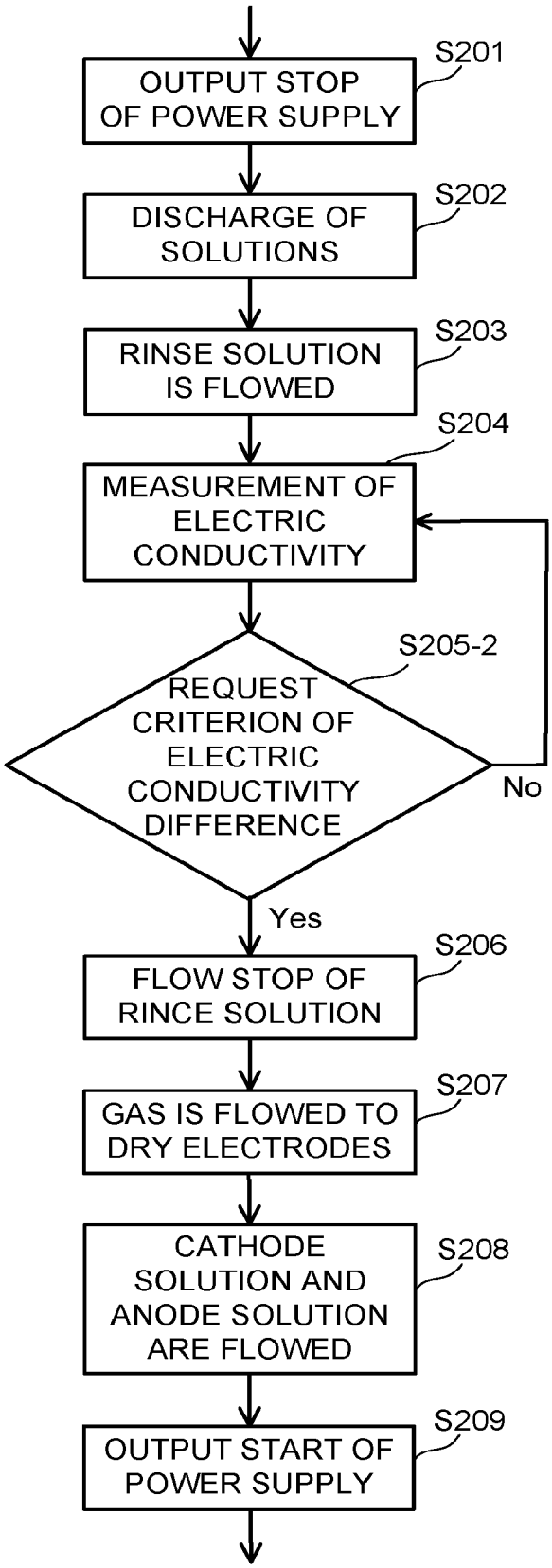
FIG. 7 is a chart illustrating a refresh step of the carbon dioxide electrolytic device of the second embodiment.

The refresh operation step S105 is performed according to a flowchart illustrated in FIG. 7, for example. An output stop of a power supply 40 (S201), a discharge of a cathode solution and an anode solution (S202), and supply of the rinse solution (S203) are performed in a manner similar to those in the flowchart of the first embodiment illustrated in FIG. 4. After starting the supply of the rinse solution, by the second electric conductivity meter 702 placed on the inflow port side to the electrolysis cell 2 and the first electric conductivity meter 701 placed on the discharge port side from the electrolysis cell 2, measurement of electric conductivities of the rinse solution is started (S204). The measurement of the electric conductivities is constantly performed, and each measured data is sent to a refresh operation controller 801.

In the refresh operation controller 801, a difference between the electric conductivity of the rinse solution before washing which has been measured by the second electric conductivity meter 702 and the electric conductivity of the rinse solution after washing which has been measured by the first electric conductivity meter 701 is computed. It is determined whether or not this difference between the electric conductivities satisfies a request criterion (S205-2). When the electric conductivity of the rinse solution after washing is reduced sufficiently and the difference between the electric conductivities is below the request criterion, the refresh operation controller 801 determines that the concentration of the salt dissolved in the rinse solution is sufficiently small, and stops the supply of the rinse solution (S206). Thereafter, supply of gas (refresh gas) (S207), introduction of the cathode solution, the anode solution, and the $CO_2$ gas (S208), and an output start of the power supply 40 (S209) are performed in a manner similar to those in the flowchart of the first embodiment illustrated in FIG. 4.

As described above, in the electrolytic device 1B of the second embodiment, similarly to the first embodiment, the refresh operation step can be performed without excessively reducing a time to perform the $CO_2$ electrolysis operation step. Moreover, since the supply of the rinse solution in the refresh operation step is stopped based on the difference between the electric conductivities of the rinse solution before and after passing through the electrolysis cell 2, also in a case of using various types of rinse solutions, a refresh operation time and an interruption time of an electrolysis operation time can be reduced without excessively performing the refresh operation step. Repeating the above $CO_2$ electrolysis operation step and refresh operation step makes it possible to operate the electrolysis cell 2 efficiently while maintaining the electrolytic performance of the electrolysis cell 2 for a long period of time.

Third Embodiment

Figure 8:
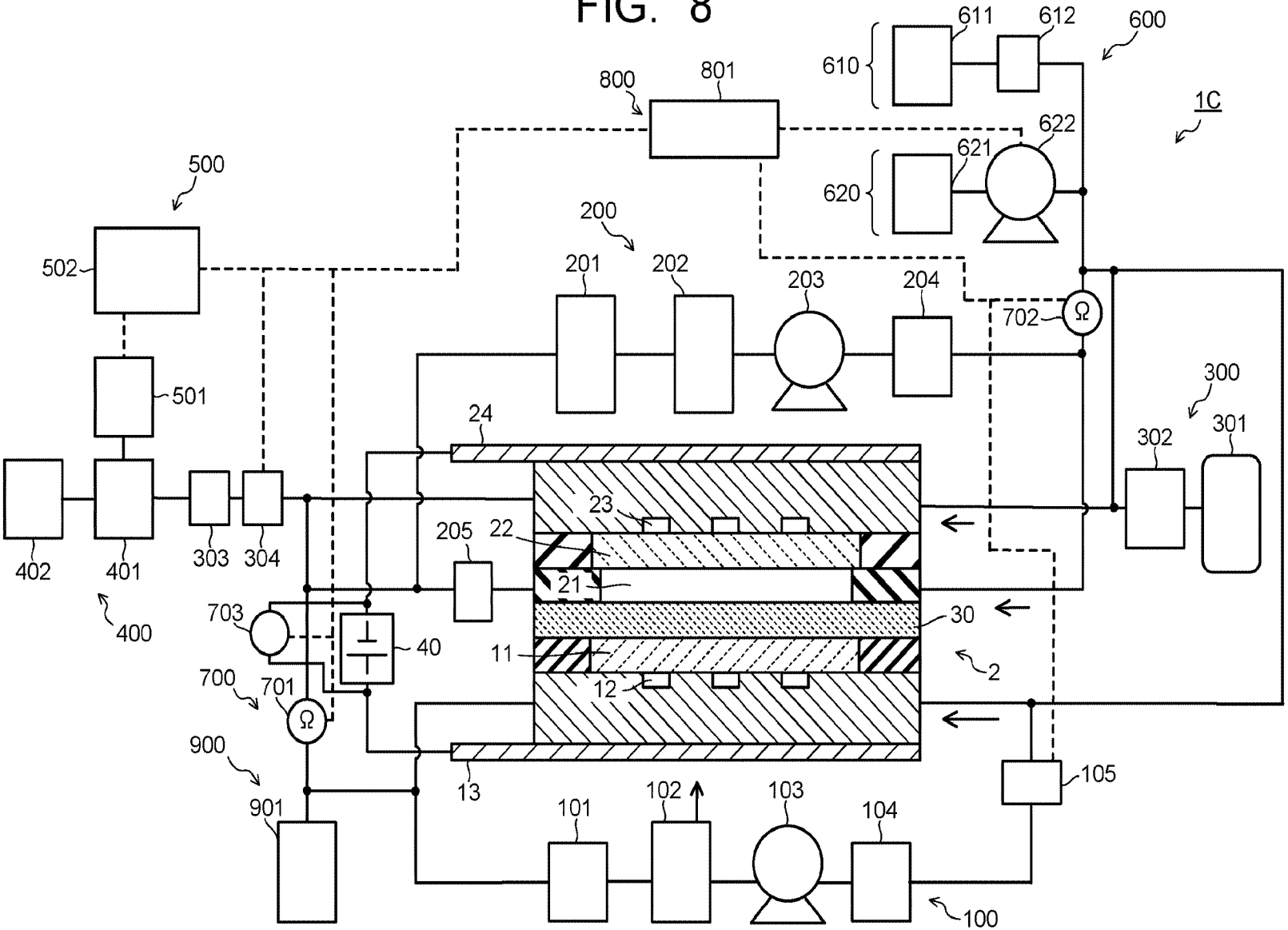
FIG. 8 is a view illustrating a carbon dioxide electrolytic device of a third embodiment.

FIG. 8 is a view illustrating a configuration of a carbon dioxide electrolytic device 1C according to a third embodiment. The carbon dioxide electrolytic device 1C illustrated in FIG. 8 is the one in which an alternating-current resistance meter 703 which measures an impedance of an electrolysis cell 2, an electrolytic solution concentration meter 105 which measures an electrolyte concentration of an anode solution circulating in an anode solution supply system 100, and a flow rate meter 304 which measures a flow rate of $CO_2$ gas flowing through in the electrolysis cell 2 are added, to the configuration of the carbon dioxide electrolytic device 1B according to the second embodiment, and has a basically similar configuration to that of the carbon dioxide electrolytic device 1B according to the second embodiment except them. The alternating-current resistance meter 703 is electrically connected to a data collection and controller 502 and a refresh operation controller 801 similarly to first and second electric conductivity meters 701 and 702, and controlled by the data collection and controller 502 so as to measure the impedance of the electrolysis cell 2 at any time during the electrolysis operation. The electrolytic solution concentration meter 105 and the flow rate meter 304 are electrically connected to the data collection and controller 502 and the refresh operation controller 801, and data measured by them is sent to the data collection and controller 502. The single electrolysis cell 2 is used in FIG. 8, but the stack-type electrolysis cell 2X illustrated in FIG. 3 may be used similarly to the first embodiment.

The carbon dioxide electrolytic device 1C according to the third embodiment has the electrolytic solution concentration meter 105 which measures the electrolyte concentration on an anode side and the flow rate meter 304 which measures the $CO_2$ gas flow rate on a cathode side, and it is possible to obtain a time integral value of a product of pieces of measurement data of these (the electrolyte concentration on an anode side and the $CO_2$ gas flow rate on a cathode side), namely, a time integral value from, a reference time being the one shorter between elapsed times from after starting a device start-up and from after stopping previous refresh operation, this reference time. Because a reduction in the time integral value means that electrolyte ions in the anode solution move to the cathode side and the $CO_2$ gas flow rate is reduced, it is determined that flow path closing begins to occur due to salt precipitation. Accordingly, by the above time integral value of the product of the electrolyte concentration and the $CO_2$ gas flow rate, a start timing of the refresh operation can be precisely determined.

Further, in the carbon dioxide electrolytic device 1C according to the third embodiment, the impedance measured by the alternating-current resistance meter 703 also indicates an operation state of the electrolysis cell 2. Accordingly, a closing state of a flow path due to the precipitation of salt can be determined from the impedance of the electrolysis cell 2. Moreover, by determining the closing state of the flow path due to the precipitation of salt including data indicating the electrolytic performance of the electrolysis cells 2 presented in the first and second embodiments, namely, electrical data such as a cell voltage, a cell current, a cathode potential, and an anode potential, and a production amount and a proportion of each product such as CO or $H_2$ in a reduction product, the performance and the state of the electrolysis cell 2 can be more securely determined. Accordingly, it becomes possible to perform the refresh operation of the electrolysis cell 2 at a more appropriate time. In addition, progress of drying of a separator can also be determined from the impedance of the electrolysis cell 2, and this can also be solved by the refresh operation.

Figure 9:
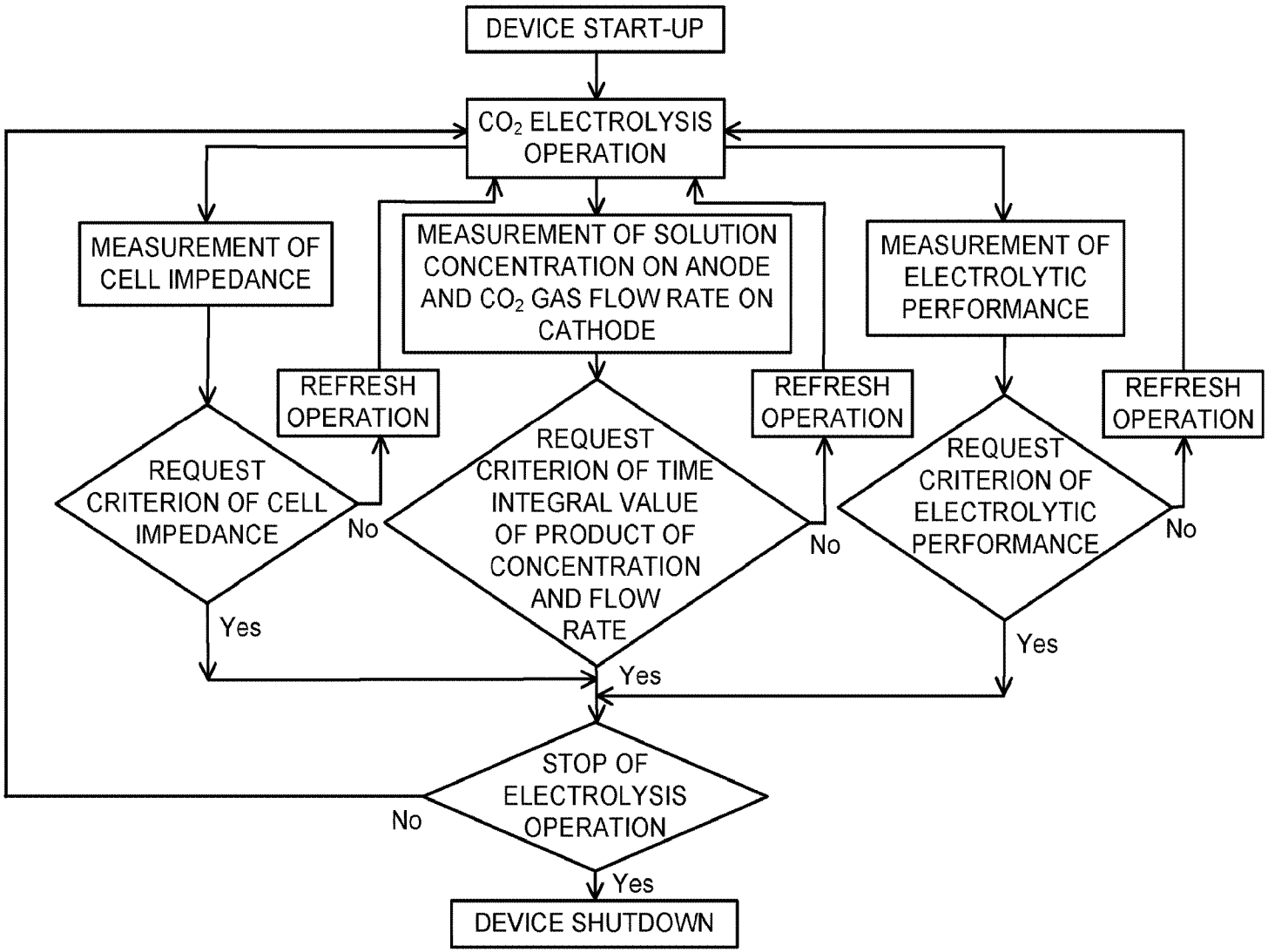
FIG. 9 is a chart illustrating an operation step of the carbon dioxide electrolytic device of the third embodiment.

A working operation of the carbon dioxide electrolytic device 1C of the third embodiment will be described based on an operation flowchart illustrated in FIG. 9. First, similarly to the working operation of the first electrolytic device 1A illustrated in FIG. 4, a start-up step and a $CO_2$ electrolysis operation step of the electrolytic device 1C are performed. After starting the $CO_2$ electrolysis operation, it is determined whether or not the above-described time integral value of the product of the electrolyte concentration on the anode side and the $CO_2$ gas flow rate on the cathode side satisfies a request criterion. At the same time, it is determined whether or not the impedance of the electrolysis cell 2 satisfies a request criterion, and further whether or not the data indicating the electrolytic performance of the electrolysis cell 2 presented in the first and second embodiments satisfies request criterions. In these determining steps, when at least one piece of the data does not satisfy the request criterion, a refresh operation step is performed. Note that whether or not the refresh operation step is performed may be determined based on a combination of a plurality of pieces of data without being limited to a piece of data.

The refresh operation step S105 is performed in a manner similar to that in the second embodiment. That is, an output stop of a power supply 40, a discharge of a cathode solution and an anode solution, and supply of a rinse solution are performed. After starting the supply of the rinse solution, by the second electric conductivity meter 702 placed on an inflow port side to the electrolysis cell 2 and the first electric conductivity meter 701 placed on a discharge port side from the electrolysis cell 2, electric conductivities of the rinse solution are measured, and a difference between the electric conductivity measured by the second electric conductivity meter 702 and the electric conductivity measured by the first electric conductivity meter 701 is computed in the refresh operation controller 801. When the electric conductivity of the rinse solution after washing is reduced sufficiently and the difference between the electric conductivities is below a request criterion, the refresh operation controller 801 determines that a concentration of the salt dissolved in the rinse solution is sufficiently small, and stops the supply of the rinse solution. Thereafter, a refresh gas is supplied, the cathode solution, the anode solution, and the $CO_2$ gas are introduced, and an output of the power supply 40 is started, to thereby perform the electrolysis operation step of the electrolysis cell 2.

As described above, in the electrolytic device 1C of the third embodiment, the closing state of the flow path of the electrolysis cell 2 can be determined more precisely, which allows the refresh operation step to be performed. In addition, the progress of drying of the separator can also be determined from the impedance of the electrolysis cell 2, and this can also be solved by the refresh operation. Accordingly, it becomes possible to maintain the performance of the electrolysis cell 2 in a better state. Moreover, since the supply of the rinse solution in the refresh operation step is stopped based on the difference between the electric conductivities of the rinse solution before and after passing through the electrolysis cell 2, also in the case of using various types of rinse solutions, a refresh operation time and an interruption time of an electrolysis operation time can be reduced without excessively performing the refresh operation step. Repeating the above $CO_2$ electrolysis operation step and refresh operation step makes it possible to operate the electrolysis cell 2 efficiently while maintaining the electrolytic performance of the electrolysis cell 2 for a long period of time.

Example 1

Figure 5:
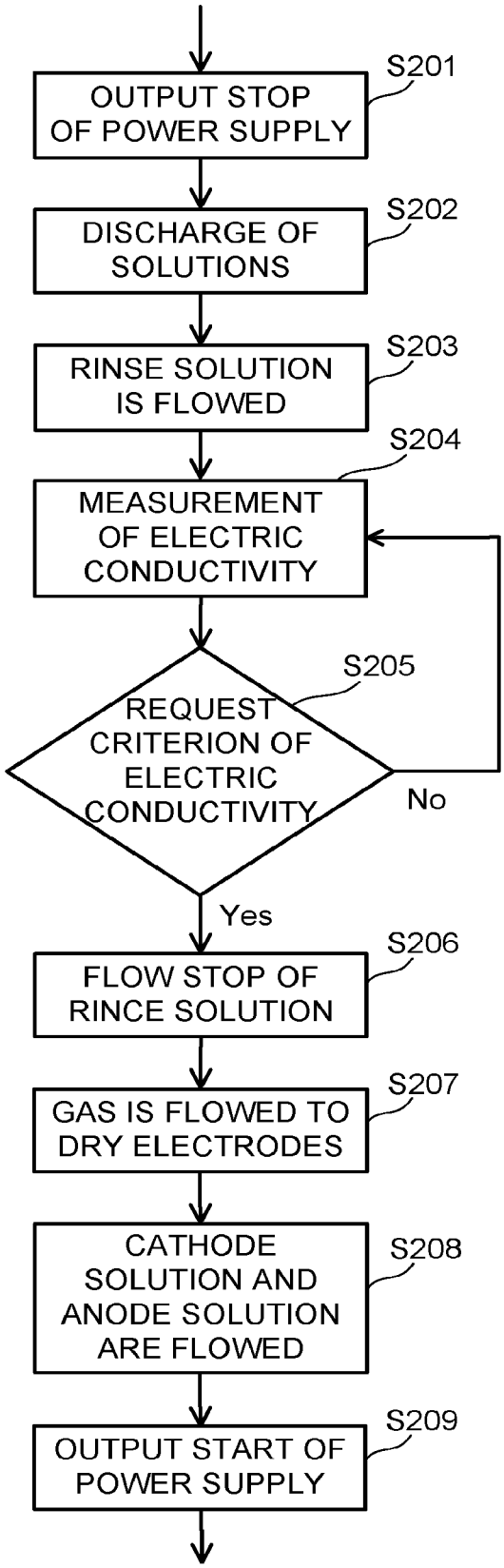
FIG. 5 is a chart illustrating a refresh step of the carbon dioxide electrolytic device of the first embodiment.
Figure 10:
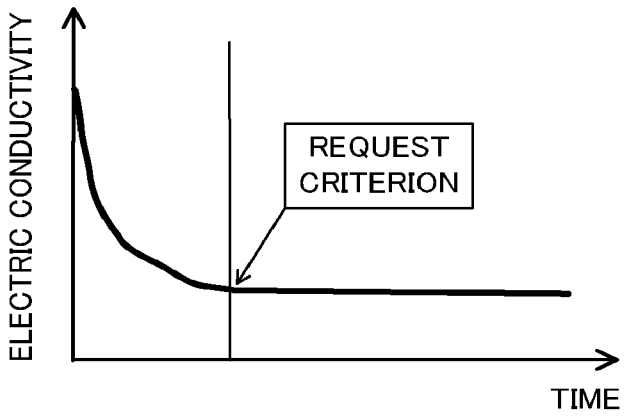
FIG. 10 is a chart illustrating one example of a relationship between an elapsed time of supply of a rinse solution and an electric conductivity of the rinse solution during a refresh step in Example 1.
Figure 11:
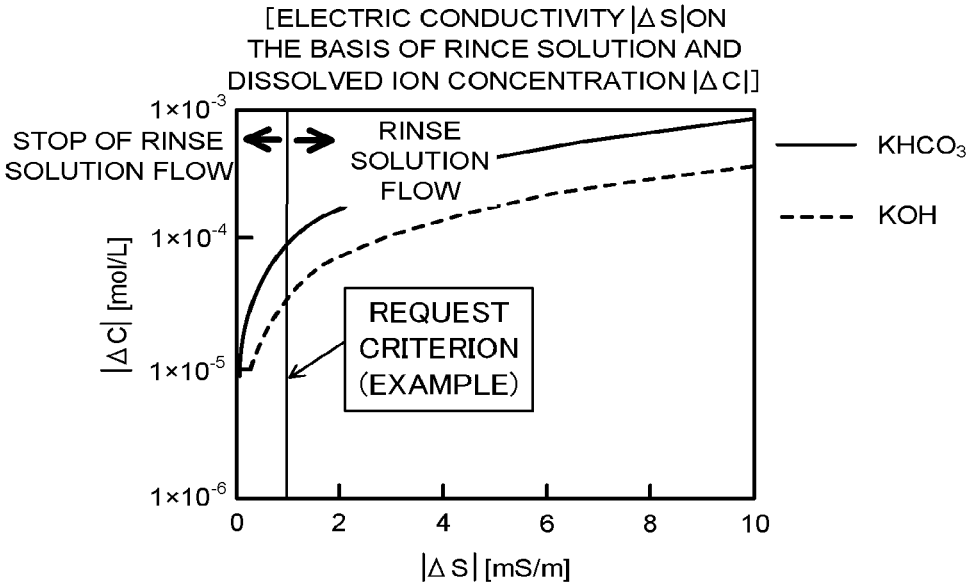
FIG. 11 is a chart illustrating an example of calculation results of a request criterion of the electric conductivity of the rinse solution during the refresh step in Example 1.

According to the first embodiment, a carbon dioxide electrolytic device having a configuration illustrated in FIG. 1 was prepared, and the electrolytic device was operated based on the operation step of the electrolytic device illustrated in FIG. 4 and the refresh step illustrated in FIG. 5. When data indicating electrolytic performance was below request criterions after the operation of the electrolytic device, the refresh step was performed. When supply of a rinse solution is continued in the refresh step, an electric conductivity of the rinse solution is reduced with time as in the schematic chart illustrated in FIG. 10, and when the electric conductivity is below a certain request criterion as indicated by calculation results illustrating the request criterion in FIG. 11, the refresh step is finished, and a power output to the electrolysis cell is started according to FIG. 5.

When the electric conductivity of the rinse solution is reduced with time and the electric conductivity is below a certain request criterion, the electric conductivity of the rinse solution is not reduced with time, and gradually approaches a constant electric conductivity. This can be determined to eliminate salt precipitation of the electrolysis cell, resulting in that $CO_2$ electrolytic performance of the electrolysis cell returns to request criteria.

Note that configurations of the above-described respective embodiments may be each applied in combination, and further may be partially substituted. Herein, while certain embodiments of the present invention have been described, these embodiments have been presented by way of example only, and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the invention.

What is claimed is:

1. A carbon dioxide electrolytic device, comprising:

an electrolysis cell comprising:

a cathode having a first surface and a second surface opposite to the first surface to reduce carbon dioxide and thus produce a carbon compound, an anode to oxidize water and thus produce oxygen, a carbon dioxide supply flow path to supply the carbon dioxide so as to be brought into contact with the second surface of the cathode and to discharge a gaseous product from the electrolysis cell, a solution supply flow path to supply an electrolytic solution so as to be brought into contact with at least the anode among the cathode and the anode, and a separator separating the anode and the cathode;

a reduction performance collection and control unit which collects and compares electrolytic performance of the carbon dioxide electrolytic device to a set performance criteria and controls when supply of carbon dioxide and/or electrolytic solution is stopped and a refresh operation performed;

a rinse solution source configured to supply a rinse solution to the solution supply flow path and the carbon dioxide supply flow path of the electrolysis cell when the refresh operation is performed and the carbon dioxide and/or the electrolytic solution is not being supplied;

a refresh gas source to supply a refresh gas to the solution supply flow path and the carbon dioxide supply flow path of the electrolysis cell;

a first electric conductivity meter provided on a discharge port side from the electrolysis cell of the carbon dioxide supply flow path to measure an electric conductivity of the rinse solution passed through the carbon dioxide supply flow path of the electrolysis cell when the carbon dioxide and/or the electrolytic solution is not supplied; and a rinse solution supply controller configured to control stop operation of the rinse solution source according to a measurement result of the first electric conductivity meter.

2. The device according to claim 1, wherein:

the first electric conductivity meter is controlled so as to measure an electric conductivity of the rinse solution at any time during the supply of the rinse solution; and the rinse solution source is controlled by the rinse solution supply controller so as to stop the supply of the rinse solution when at least one of an electric conductivity of the rinse solution and a time change in the electric conductivity is equal to or less than a request criterion.

3. The device according to claim 1, further comprising a second electric conductivity meter provided on an inflow port side to the electrolysis cell of the carbon dioxide supply flow path to measure an electric conductivity of the rinse solution supplied to the carbon dioxide supply flow path from the rinse solution source of the electrolysis cell when the carbon dioxide and/or the electrolytic solution is not being supplied, wherein the rinse solution source is controlled by the rinse solution supply controller so as to stop the supply of the rinse solution when a difference between an electric conductivity of the rinse solution measured by the second electric conductivity meter and an electric conductivity of the rinse solution measured by the first electric conductivity meter is equal to or less than a request criterion.

4. The device according to claim 1, wherein the reduction performance collection and control unit is configured to collect reduction performance data including at least one selected from a cell voltage, a cell current, a cathode potential, an anode potential of the electrolysis cell, a production amount of a reduction product caused by the cathode, and a product proportion in the reduction product; and is configured to control operation and non-operation of the electrolysis cell based on the reduction performance data.

5. The device according to claim 1, further comprising:

an electrolytic solution concentration meter to measure a concentration of the electrolytic solution in the solution supply flow path which supplies the electrolytic solution to the anode; and a flow rate meter to measure a gas flow rate in the carbon dioxide supply flow path.

6. The device according to claim 5, further comprising an electrolysis operation controller configured to control the electrolysis cell so as to stop operation of the electrolysis cell when a time integral value of a product of the concentration of the electrolytic solution and the gas flow rate from a reference time is equal to or less than a request criterion, the reference time being the one shorter between elapsed times from after starting a device start-up and from after stopping a previous refresh operation, wherein the rinse solution supply controller controls the rinse solution source so as to start supply of the rinse solution after the operation stop of the electrolysis cell.

7. The device according to claim 1, further comprising an alternating-current resistance meter to measure an impedance of the electrolysis cell.

8. The device according to claim 7, further comprising an electrolysis operation controller configured to control the electrolysis cell so as to stop operation of the electrolysis cell when the impedance is equal to or less than a request criterion, wherein the rinse solution supply controller controls the rinse solution source so as to start supply of the rinse solution after the operation stop of the electrolysis cell.

9. The device according to claim 1, wherein the solution supply flow path includes a first solution supply flow path to supply an electrolytic solution so as to be brought into contact with the anode, and a second solution supply flow path to supply an electrolytic solution so as to be brought into contact with the cathode.

10. A method for electrolyzing carbon dioxide, comprising:

supplying carbon dioxide to a carbon dioxide supply flow path in an electrolysis cell, and supplying an electrolytic solution to a solution supply flow path in the electrolysis cell, the electrolysis cell having an anode, a cathode, the carbon dioxide supply flow path which supplies the carbon dioxide to the cathode, and the solution supply flow path which supplies the electrolytic solution to at least the anode among the cathode and the anode;

supplying a current from a power supply connected to the anode and the cathode, to reduce carbon dioxide and thus produce a carbon compound in a vicinity of the cathode, and to oxidize water and thus produce oxygen in a vicinity of the anode;

stopping the current supply from the power supply and the supply of the carbon dioxide and the electrolytic solution, based on request criteria of reduction performance of the electrolysis cell, and supplying a rinse solution to the carbon dioxide supply flow path of the electrolysis cell to which the carbon dioxide and the electrolytic solution is not supplied; and measuring an electric conductivity of the rinse solution passed through the carbon dioxide supply flow path of the electrolysis cell by using a first electric conductivity meter provided on a discharge port side from the electrolysis cell of the carbon dioxide supply flow path and stopping the supply of the rinse solution according to a measurement result of the first electric conductivity meter.

11. The method according to claim 10, wherein the supply of the rinse solution is stopped when at least one of a value of the electric conductivity of the rinse solution measured by the first electric conductivity meter and a time change in the electric conductivity is equal to or less than a request criterion.

12. The method according to claim 10, wherein:

an electric conductivity of the rinse solution is measured by a second electric conductivity meter provided on an inflow port side to the electrolysis cell of at least one of the solution supply flow path and the carbon dioxide supply flow path; and the supply of the rinse solution is stopped when a difference between an electric conductivity of the rinse solution measured by the second electric conductivity meter and an electric conductivity of the rinse solution measured by the first electric conductivity meter is equal to or less than a request criterion.

13. The method according to claim 10, wherein the current supply from the power supply and the supply of the carbon dioxide and the electrolytic solution are stopped when reduction performance data including at least one selected from a cell voltage, a cell current, a cathode potential, an anode potential of the electrolysis cell, a production amount of a reduction product caused by the cathode, and a product proportion in the reduction product is collected and the reduction performance data is equal to or less than a request criterion.

14. The method according to claim 10, wherein a concentration of the electrolytic solution in the solution supply flow path which supplies the electrolytic solution to the anode is measured, and a gas flow rate in the carbon dioxide supply flow path is measured; and the current supply from the power supply and the supply of the carbon dioxide and the electrolytic solution are stopped when a time integral value of a product of the concentration of the electrolytic solution and the gas flow rate from a reference time is equal to or less than a request criterion, the reference time being the one shorter between elapsed times from after starting a device start-up and from after stopping previous refresh operation.

15. The method according to claim 10, wherein the current supply from the power supply and the supply of the carbon dioxide and the electrolytic solution are stopped when an impedance of the electrolysis cell is measured and the impedance is equal to or less than a request criterion.

* * * * *